US005207189A

United States Patent [19]

Kawauchi et al.

[11] Patent Number: 5,207,189

[45] Date of Patent: May 4, 1993

[54] COOLING SYSTEM FOR AN INTERNAL COMBUSTION ENGINE

[75] Inventors: Masato Kawauchi, Mishima; Masayoshi Tokoro, Susono; Shizuo Abe, Mishima, all of Japan

[73] Assignee: Toyota Jidosha Kabushiki Kaisha, Aichi, Japan

[21] Appl. No.: 906,499

[22] Filed: Jun. 30, 1992

[30] Foreign Application Priority Data

Jul. 8, 1991 [JP] Japan ..... 3-166975
Jul. 10, 1991 [JP] Japan ..... 3-170152
Jul. 18, 1991 [JP] Japan ..... 3-178498
Jul. 18, 1991 [JP] Japan ..... 3-178499

[51] Int. Cl.[5] ..... F02F 1/10
[52] U.S. Cl. ..... 123/41.84; 123/41.79
[58] Field of Search ..... 123/41.72, 41.79, 41.83, 123/41.84

[56] References Cited

U.S. PATENT DOCUMENTS 2,078,499 4/1937 Ljungström ..... 123/41.84

FOREIGN PATENT DOCUMENTS 63-168242 11/1988 Japan .
3-78518 8/1991 Japan .

*Primary Examiner*—Noah P. Kamen
*Attorney, Agent, or Firm*—Oliff & Berridge

[57] ABSTRACT

A cooling system for an internal combustion engine eliminate stagnation of a coolant flowing in a plurality of annular passages formed between a cylinder block and a cylinder liner along a circumference of an outer surface of the cylinder linear. Inflow and outflow passages, connected to the annular passages, are provided extending in a direction of an axis of the cylinder liner. An inlet passage, supplying a coolant to the inflow passage, is provided. A guiding member is provided at an entrance of each of the annular passages so as to lead a portion of a coolant to an upstream side of each of the annular passages. Sufficient amount of coolant flows through the annular passages of the cylinder linear, and thus the wall of the cylinder liner can be cooled efficiently.

15 Claims, 11 Drawing Sheets

COOLING SYSTEM FOR AN INTERNAL COMBUSTION ENGINE

BACKGROUND OF THE INVENTION

1. Field of the Invention

The present invention relates to a cooling system for an internal combustion engine, and more particularly to a cooling system which cools an internal combustion engine by allowing coolant to flow inside annular grooves provided on an outer surface of a cylinder.

2. Description of the Related Art

Conventionally, there is disclosed a cooling system of a cylinder liner, for example in Japanese Laid-Open Utility Model Application No. 63-168242. The cooling system disclosed in this Application, so called groove cooling, includes a plurality of grooves formed on and along an outer surface of a cylinder liner in a direction roughly perpendicular to an axis of the cylinder liner. The system also includes two connecting grooves connecting these grooves and extending in the direction of the axis of the cylinder liner. The later grooves are positioned in 180 degree opposition from each other along a diameter of the cylinder liner. Continuing passages for coolant are formed between each of the grooves on the outer surface of the cylinder liner and the inner surface of a bore of a cylinder block by fitting the cylinder liner to the bore of the cylinder block.

FIGS. 1A and 1B show an example cooling system for an internal combustion engine; FIG. 1A is a plane view and FIG. 1B is a cross sectional view taken along a line B—B of FIG. 1A. A plurality of square cross-sectioned annular grooves $3_1 \sim 3_4$ are formed on an outer surface of a cylinder liner 2. The annular grooves $3_1 \sim 3_4$, extending in a direction roughly parallel to the circumference of the cylinder liner, are equally spaced along a direction of the axis of the cylinder liner 2 that is fitted to a cylinder block 1. When the cylinder liner 2 is fitted to the bore of the cylinder block 1, these annular grooves $3_1 \sim 3_4$ form annular passages between an outer surface of the cylinder liner 2 and an inner surface 4 of a bore of the cylinder block 1.

Longitudinal grooves 5 and 6 connecting the grooves $3_1 \sim 3_4$ are formed, extending in a direction of an axis of the cylinder liner 2, in positions where the cylinder liner 2 and the cylinder block 1 face each other. In the cylinder block 1, an inlet port 7, which is connected to the longitudinal groove 5, and an outlet port 8, which is connected to the longitudinal groove 6, are formed.

A coolant delivered from a pump (not shown) is supplied to the inlet port 7. The coolant supplied to the inlet port 7 flows through the longitudinal groove 5 and is delivered to the annular grooves $3_1 \sim 3_4$. Then the coolant flows through the grooves $3_1 \sim 3_4$ while absorbing heat from the cylinder liner 2, and eventually flows into the longitudinal groove 6. The coolant flows together in the longitudinal groove 6, outflows from the outlet port 8, and is returned to the pump via a radiator (not shown).

In the system mentioned above, heat generated in a combustion chamber and transfered from a cylinder head to the cylinder liner 2 can be eliminated by cooling a wall of the cylinder liner 2. The wall of the cylinder liner 2 has an incoming heat distribution such that the incoming heat at the uppermost part of the cylinder liner 2 is highest. The amount of heat decreases toward the lower part of the cylinder liner 2. Therefore, the amount of coolant flow in the annular groove $3_1$ closest to a combustion chamber is maximized and the flow decreases as it flows to the grooves $3_2 \sim 3_4$ from the uppermost groove $3_1$, so as to uniformly cool down the wall of the cylinder liner 2.

In the conventional system mentioned above, as shown in FIG. 2, a coolant flows into the inlet port 7, and almost directly enters into the uppermost groove $3_1$ via the longitudinal groove 5. Some coolant flows into the grooves $3_2 \sim 3_4$, which are lower than the uppermost groove $3_1$. Part of the flow into grooves $3_2 \sim 3_4$ is bent perpendicularly, as indicated by arrows a and b in FIG. 2. However, since the coolant flows at high velocity, due to an inertia, it is difficult for the coolant to change a flow direction to a perpendicular direction thereof. Accordingly, in the grooves $3_2 \sim 3_4$ located below than the uppermost groove $3_1$, a stagnation of the coolant is generated in an upstream position of each groove as indicated by arrows c and d. This stagnation is largest at the second groove $3_2$ and tends to be reduced toward lower positions of the grooves. This is because the velocity of the coolant is higher at the entrance of the longitudinal groove 5 and decreases toward the downstream side due to reduced coolant flow. The result is that in inertia of the coolant flow is higher at the entrance of the second groove $3_2$ and lower towards the downstream position.

If stagnation of the coolant is generated at the upper portion of the cylinder liner 2, where the amount of incoming heat is considerably large, the coolant receives an excess amount of heat and begins boiling. If the vapor generated by the boiling of the coolant flows into a circulation pump for the coolant, the amount of coolant discharged from the pump will be reduced and result in an overheating of the internal combustion engine.

SUMMARY OF THE INVENTION

It is a general object of the present invention to provide an improved cooling system for an internal combustion engine in which the above-mentioned disadvantages are eliminated.

A more specific object of the present invention is to provide a cooling system in which a stagnation of a coolant flow generated at an entrance of each annular groove is eliminated so as to prevent boiling of the coolant, and thus prevent a decrease of a cooling effect of a cylinder liner of an internal combustion engine.

The above-mentioned objects of the present invention are achieved by a cooling system comprising:

a supply source of a coolant cooling a cylinder liner;

a plurality of annular passages, formed between a cylinder block and the cylinder liner fitted in the cylinder block along a circumference of an outer surface of the cylinder liner, the annular passages spaced apart from each other in an axial direction of the cylinder liner;

an inflow and an outflow passage for a coolant, connecting the plurality of annular passages, extending in a direction of an axis of the cylinder liner, and provided at diametrically opposite sides of the cylinder liner;

an inlet passage supplying a coolant to the inflow passage; and introducing means for a coolant, provided so as to prevent generation of a stagnation of the coolant introduced to the annular passages.

According to the present invention, the introducing means eliminates any stagnation in the coolant flowing into each annular passage. As a result, a sufficient amount of coolant flows through the annular passages of the cylinder liner. Therefore, heat of the cylinder liner can be appropriately eliminated, and thus the wall of the cylinder liner can be cooled efficiently.

Other objects, features and advantages of the present invention will become more apparent from the following detailed description when read in conjunction with the accompanying drawings.

BRIEF DESCRIPTION OF THE DRAWINGS

FIG. 1A is a plane view and FIG. 1B is a cross sectional view taken along a line B—B of FIG. 1A;

DESCRIPTION OF THE PREFERRED EMBODIMENTS

Figure 3:
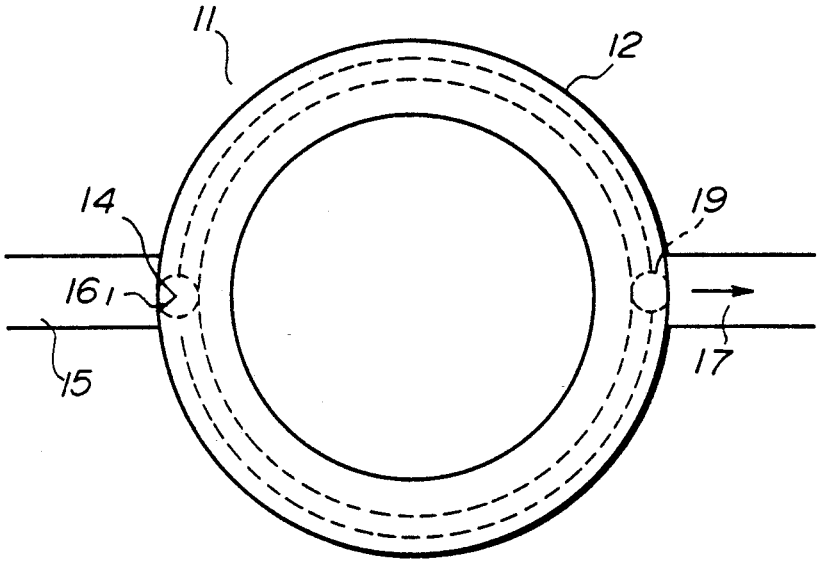
FIG. 3 is a plane view of a first embodiment of the present invention.

A description will now be given of a first embodiment of the present invention with reference to FIG. 3 and FIG. 4. A plurality of annular grooves $\mathbf{13_1 \sim 13_3}$ circumferentially formed on an outer surface of a cylinder liner 12 are spaced apart from each other in a direction of the axis of the cylinder liner 12. The annular grooves $\mathbf{13_1 \sim 13_3}$ and an inner surface of a bore of a cylinder block 11 jointly form annular passages for a coolant.

Longitudinal grooves 14 and 19 ar formed on an inner surface of the cylinder block 11, and on the outer surface of the cylinder liner 12. The grooves 14,19 extend in the direction of the axis of the cylinder liner 12 and are located at diametrically opposite sides of the liner 12. The plurality of annular grooves $\mathbf{13_1 \sim 13_3}$ are connected to each other by the grooves 14,19. The groove 14 serves as an inflow passage of a coolant and the groove 19 serves as an outflow passage of the coolant.

An inlet passage 15 is connected to the groove 14 and an outlet passage 17 is connected to the groove 19. The conjunction of the inlet passage 15 and the groove 14 functions as an introducing passage part for an inflowing coolant to the annular grooves $\mathbf{13_1 \sim 13_3}$. The inlet passage 15 is formed so as to be approximately an extension in the radial direction of the annular groove $\mathbf{13_1}$, which is one of the annular grooves $\mathbf{13_1 \sim 13_3}$, located on the uppermost portion of the cylinder liner 12. The grooves $\mathbf{13_2}$, $\mathbf{13_3}$ located below the uppermost groove $\mathbf{13_1}$ are not in an extension position of the inlet passage 15. Accordingly, a portion of coolant flowing into the grooves $\mathbf{13_2}$, $\mathbf{13_3}$ is bent so as to flow perpendicular to the longitudinal direction of the groove 14.

This embodiment features guiding members $\mathbf{16_1}$ and $\mathbf{16_2}$, as introducing means for a coolant, provided at the portions of the groove 14 close to the respective entrance portions of the annular groove $\mathbf{13_2}$ and $\mathbf{13_3}$. Each of the guiding members $\mathbf{16_1}$ and $\mathbf{16_2}$ has a square cross section and triangular shape with a vertex that directs flow to the grooves $\mathbf{13_2}$ and $\mathbf{13_3}$. As shown in FIG. 4, the guiding member $\mathbf{16_1}$ is positioned within the upper half $\frac{1}{2}$L of a width L of the annular groove $\mathbf{13_2}$ so that a portion of coolant is led to the upstream portion of the annular groove $\mathbf{13_2}$. The guiding member $\mathbf{16_2}$ is provided in the same manner as that of the guiding member $\mathbf{16_1}$.

Flow of the coolant in this embodiment is explained below. A coolant, delivered from a pump (not shown), flows into the inlet passage 15, as indicated by an arrow I. A portion of the coolant flows into the groove 14 then, without changing its direction of flow, enters the uppermost groove $\mathbf{13_1}$ as indicated by an arrow II. The rest of the coolant flows inside the longitudinal groove 14, as indicated by an arrow III, and a portion thereof is led into the upstream portion of the entrance of the groove $\mathbf{13_2}$ by the guiding member $\mathbf{16_1}$. This portion of coolant flows downstream the groove $\mathbf{13_2}$. The remaining coolant flows into the lower part of the longitudinal groove 14. In the same manner, a portion of the coolant is led to the upstream portion of the groove $\mathbf{13_3}$, as indicated by an arrow IV.

After the coolant enters the annular grooves $\mathbf{13_1 \sim 13_3}$, the coolant flows along the grooves $\mathbf{13_1 \sim 13_3}$, while absorbing heat from the cylinder liner 12, then the coolant in each groove $\mathbf{13_1 \sim 13_3}$ enters the longitudinal groove 19. The coolant from the grooves $\mathbf{13_1 \sim 13_3}$ flows together in the groove 19 and the joined coolant flows out via the outlet passage 17.

As mentioned above, in the conventional cooling system, a stagnation is generated at the upstream portion of the annular groove $\mathbf{13_2}$ because the direction of the coolant flow can not be acutely bent to the direction of the groove $\mathbf{13_2}$ due to the high velocity thereof. On the other hand, in this embodiment, the coolant is positively led to the upstream portion of the groove $\mathbf{13_2}$ by the guiding member $\mathbf{16_1}$, and thus the coolant flows smoothly throughout the entire groove $\mathbf{13_2}$ and stagnation is not generated. Coolant flow the groove $\mathbf{13_3}$ proceeds in the same manner as in the groove $\mathbf{13_2}$. Therefore, the boiling of the coolant is eliminated and overheating of the engine is prevented.

Figure 4:
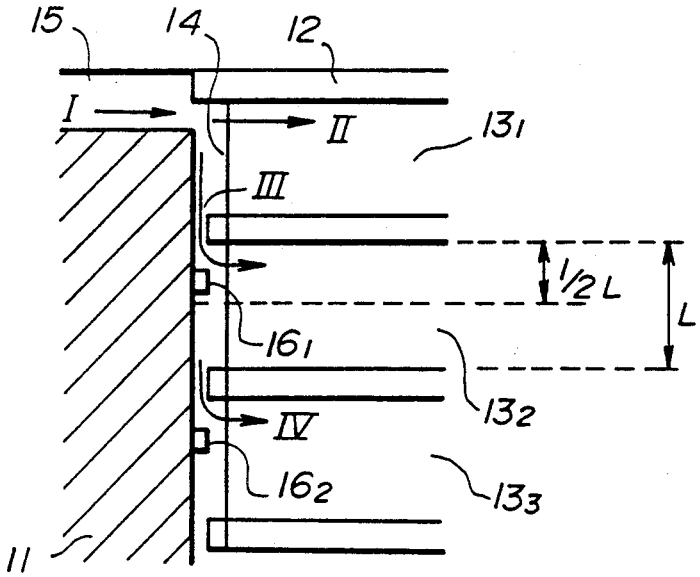
FIG. 4 is a partial cross sectional view of a first embodiment of the present invention.
Figure 5:
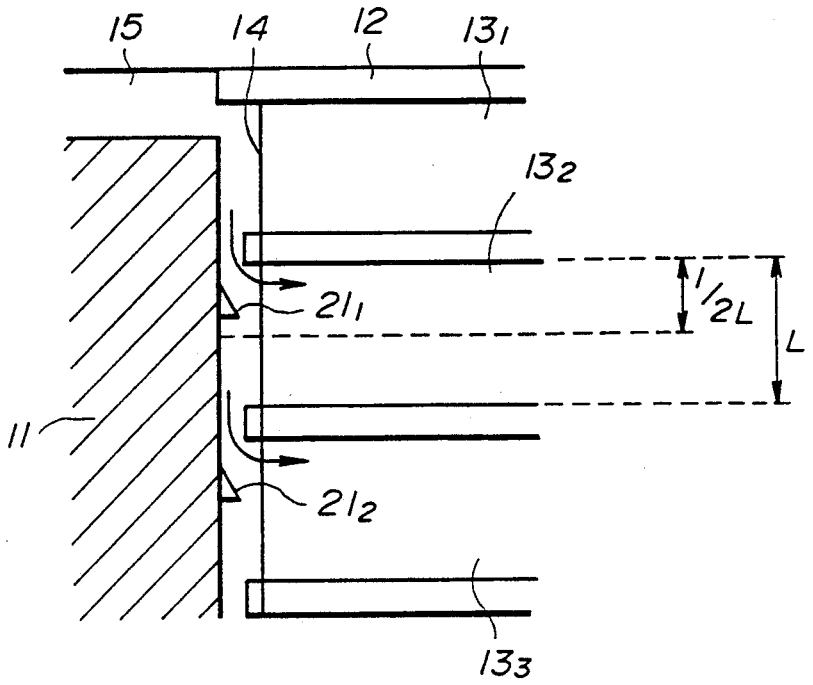
FIG. 5 is a partial cross sectional view of a second embodiment of the present invention.

FIG. 5 is a partial cross sectional view of a second embodiment of the present invention. In FIG. 5, those parts that are the same as corresponding parts in FIG. 4 are designated by the same reference numerals, and descriptions thereof will be omitted.

This embodiment features guiding members $\mathbf{21_1}$ and $\mathbf{21_2}$, as introducing means for a coolant, provided at the portions of the groove 14 close to the respective entrances of the annular groove $\mathbf{13_2}$ and $\mathbf{13_3}$, in a manner similar to that in the above mentioned first embodiment of the present invention. Each of the guiding members $21_1$ and $21_2$ has a triangular cross section and a triangular shape with a vertex directed toward the grooves $13_2$ and $13_3$ respectively. As shown in FIG. 5, the guiding member $21_1$ is positioned within the upper half ($\frac{1}{2}$L where L is the width of the passage) of the annular groove $13_2$ so that a portion of coolant is led into the upstream portion of the annular groove $13_2$. The guiding member $21_2$ is provided in the same manner as that of the guiding members $21_1$.

Apparent from FIG. 5 and the above description, this embodiment has the same effect for a coolant flow as explained in the description of the first embodiment mentioned above. In addition, each of the guiding members $21_1$ and $21_2$ of this embodiment has a slanting surface which allows the coolant to be smoothly led to the grooves $13_2$ and $13_3$ with less pressure loss than in the previous embodiment.

Figure 6:
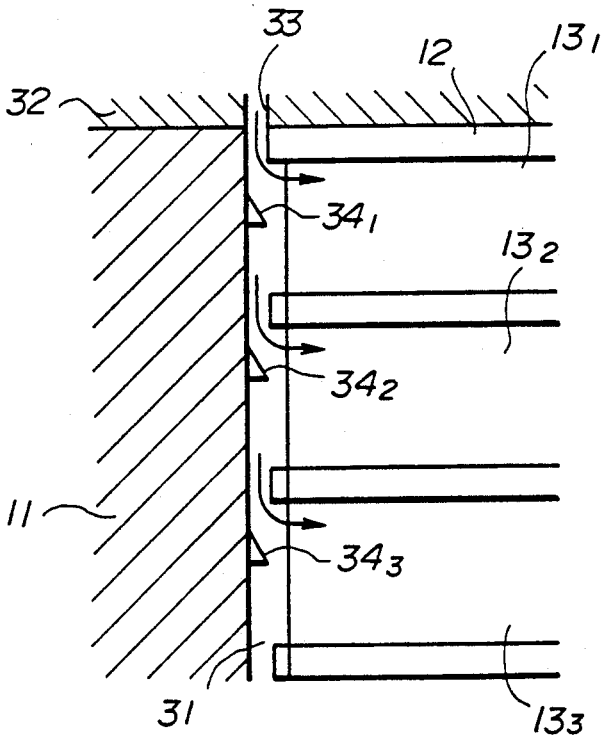
FIG. 6 is a partial cross sectional view of a variation of the second embodiment of the present invention.

The present invention is not limited to the above mentioned first and second embodiments, for example, as shown in FIG. 6, a guiding member is provided also to the uppermost groove $13_1$ for the system in which an inlet passage 33 is formed in a cylinder head 32 which passage lies in an extension direction of a longitudinal groove 31 corresponding to the longitudinal groove 14 of FIG. 5. Guiding members $34_2$ and $34_3$ are provided for the grooves $13_2$ and $13_3$ respectively.

Additionally, those guiding members may be applied to a cooling system in which an inlet passage is formed at a portion most distant from a cylinder head. In this case the same effect as in the embodiments above is expected.

Figure 7:
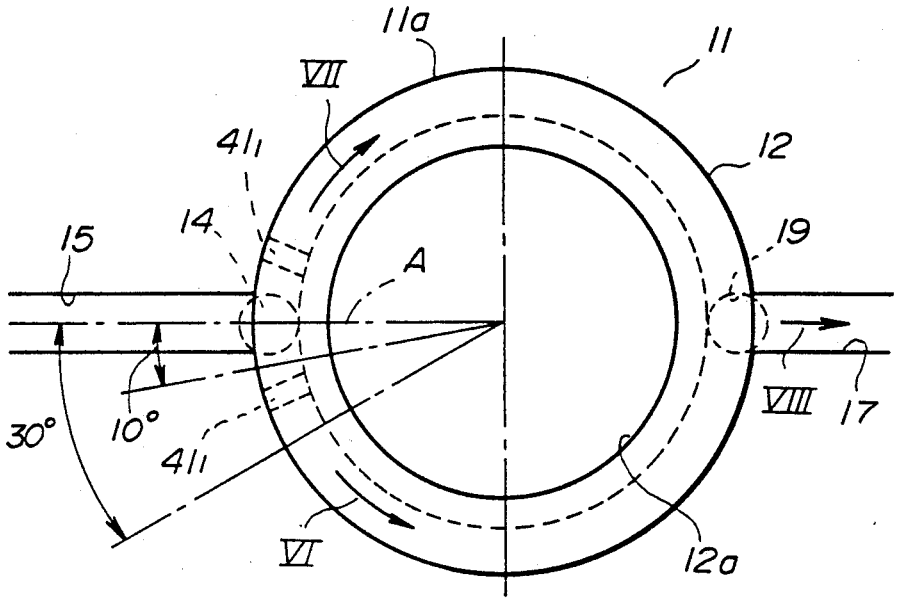
FIG. 7 is a plane view of a third embodiment of the present invention.
Figure 8:
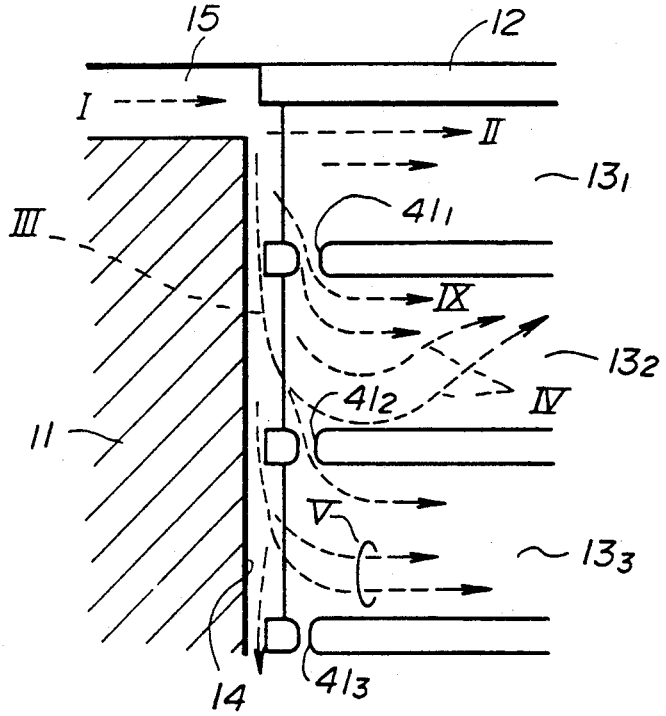
FIG. 8 is a partial cross sectional view of a third embodiment of the present invention.

A description will now be given of a third embodiment of the present invention with reference to FIG. 7 and FIG. 8. In FIGS. 7 and 8, those parts that are the same as corresponding parts in FIGS. 3 and 4 are designated by the same reference numerals, and descriptions thereof will be omitted.

This embodiment features connecting ports $41_1 \sim 41_3$, as introducing means for a coolant, provided on walls between annular grooves $13_1 \sim 13_3$. As shown in FIG. 7, the connecting ports $41_1 \sim 41_3$ are located within an angle range of 10° ~ 30° from the line A, which line A is a line passing through the center of a vertical cross section of a longitudinal groove 14 and the center of the circular cross section of a cylinder liner 12, symmetrically on both sides of the line A.

Each of the connecting ports $41_1 \sim 41_3$ comprises a notch formed on a wall between the grooves, so as to connect two adjacent grooves, such as the grooves $13_1$ and $13_2$, the grooves $13_2$ and $13_3$, the groove $13_3$ and the lower groove not shown. The angle range of 10° ~ 30° is obtained from the results of an experiment that a stagnation is generated within that angle range.

The area of the cross section of each of the connecting ports $41_1 \sim 41_3$ is reduced toward the lower portion of the cylinder. In other words, the area of the cross section of the connecting port $41_1$ is largest, and that of the port $41_2$ is smaller than that of the port $41_1$, and that of the port $41_3$ is smaller than that of the port $41_2$.

Flow of the coolant in this embodiment is explained below. A coolant, delivered from a pump (not shown), flows into the inlet passage 15, as indicated by an arrow I. A portion of the coolant flows into the groove 14 and enters, without changing direction, into the uppermost groove $13_1$, as indicated by an arrow II. The rest of the coolant flows inside the longitudinal groove 14, as indicated by an arrow III, and a portion thereof flows into the groove $13_2$ and the remaining flows to the lower part of the longitudinal groove 14. In the same manner, a portion of the coolant flows into the groove $13_3$, as indicated by an arrow V.

After the coolant enters the annular grooves $13_1 \sim 13_3$, the coolant flows along the grooves $13_1 \sim 13_3$, while absorbing heat from the cylinder liner 12, then the coolant in each groove $13_1 \sim 13_3$ enters the longitudinal groove 19. The coolant from the grooves $13_1 \sim 13_3$ flows together in the groove 19 and the joined coolant flows out via the outlet passage 17.

In this embodiment, a portion of the coolant, entering into the annular grooves $13_1$ at a high velocity, is introduced to the upstream portion of the groove $13_2$, where stagnation is generated in the conventional cooling system, via the connecting port $41_1$. Accordingly, a stagnation of the coolant is eliminated in the groove $13_1$. The coolant entering the lower grooves flows in the same manner as that in the groove $13_1$.

Figure 1A:
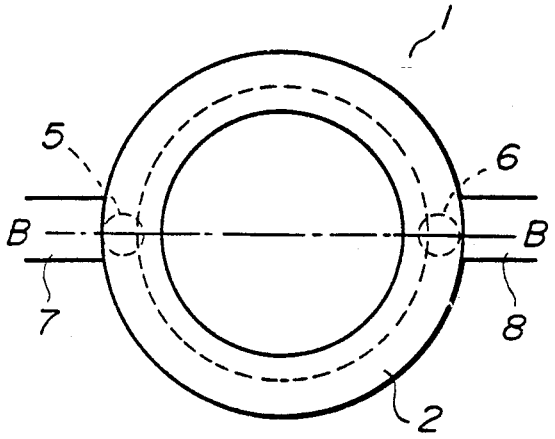
FIG. 1A PRIOR ART
FIGS. 1A and 1B show an example of a conventional cooling system for an internal combustion engine.
Figure 1B:
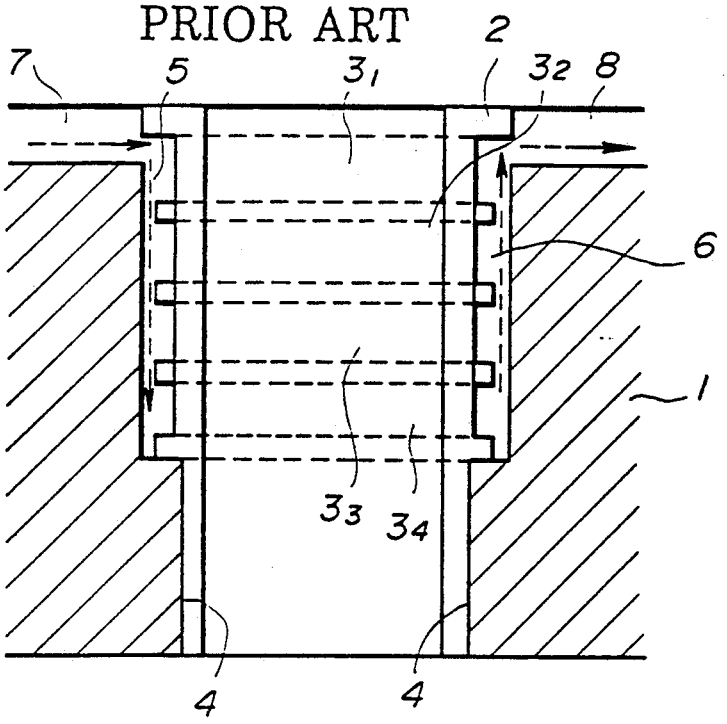
FIG. 1B PRIOR ART
Figure 2:
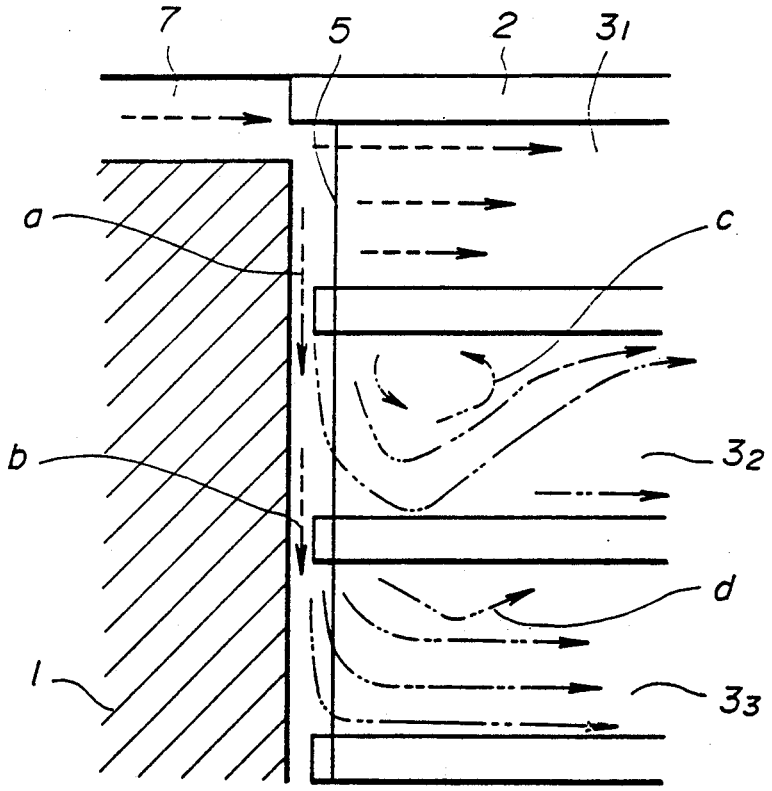
FIG. 2 PRIOR ART
FIG. 2 is a partial cross sectional view of the conventional cooling system for explaining a flow of a coolant.

As mentioned above, in the conventional cooling system, a stagnation is generated at the upstream portion of the annular groove $13_2$ because the direction of the coolant flow can not be acutely bent to match the direction of the groove $13_2$ due to the high velocity of the fluid. On the other hand, in this embodiment, the coolant entered into the groove $13_1$ is led to the upstream portion of the groove $13_2$ via the connecting port $41_1$, and thus the coolant flows smoothly through the entire groove $13_2$ and a stagnation, shown in FIG. 2, is not generated. Coolant flow to the groove $13_3$ flows in the same manner as that in the groove $13_2$. Therefore, the boiling of the coolant is eliminated and overheating of the engine is prevented.

In addition, since the area of the cross section of the connecting ports $41_1 \sim 41_3$ becomes larger towards the upper portion of the cylinder liner 12, a distribution of the amount of the coolant flowing in the grooves $13_1 \sim 13_3$ can be matched to a distribution of the incoming heat of the cylinder liner 12. This results in a cooling effect which allows for maintaining a uniform temperature of the cylinder liner 12.

Figure 9:
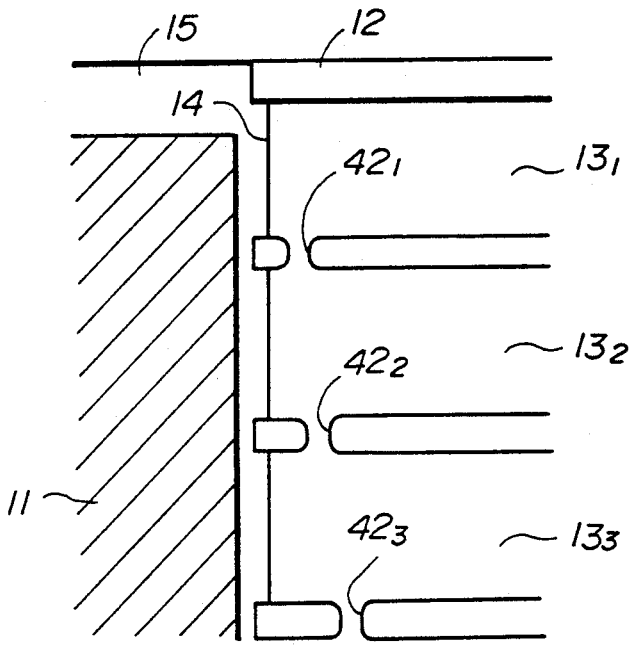
FIG. 9 is a partial cross sectional view of a fourth embodiment of the present invention.

FIG. 9 is a partial cross sectional view of a fourth embodiment of the present invention. In FIG. 9, those parts that are the same as corresponding parts in FIG. 4 are designated by the same reference numerals, and descriptions thereof will be omitted.

This embodiment features connecting ports $42_1 \sim 42_3$, as introducing means for a coolant, provided on walls between annular grooves $13_1 \sim 13_3$. Similarly to the connecting ports $41_1 \sim 41_3$ in the third embodiment, the connecting ports $42_1 \sim 42_3$ are located within an angle range of 10° ~ 30° from the line A in FIG. 7, which line A is a line passing through the center of a vertical cross section of a longitudinal groove 14 and the center of a circular cross section of a cylinder liner 12, symmetrically on both sides of the line A.

Each of the connecting ports $42_1 \sim 42_3$ comprises a notch formed on a wall between the grooves, so as to connect two adjacent grooves, such as the grooves $13_1$ and $13_2$, the grooves $13_2$ and $13_3$, the groove $13_3$ and the lower groove not shown. Unlike the connecting ports $41_1 \sim 41_3$ in the third embodiment, the area of the cross section of each connecting ports $41_1 \sim 41_3$ is the same, but the positions of the connecting ports $42_1 \sim 42_3$ are varied. The position of connecting ports $42_1$ is closest to the longitudinal groove 14 and the distance between the groove 14 and other connecting ports increases toward the lower portion of the cylinder liner 12.

According to the results of an experiment, the stagnation areas, generated in progressively higher grooves, occur at positions progressively closer to the longitudinal groove 14 of the cylinder liner 12. The reason for this arrangement of the connecting ports $42_1 \sim 42_3$ is to match the positions of the connecting ports $42_1 \sim 42_3$ to the positions where stagnation is generated.

Apparently, by this embodiment, the coolant entering the groove $13_1$ is led to the upstream portion of the groove $13_2$ via the connecting port $42_1$, and thus the coolant smoothly flows through the entire groove $13_2$, and a stagnation, shown in FIG. 2, is not generated. A coolant flow to the groove $13_3$ flows in the same manner as that in the groove $13_2$. Therefore, the boiling of the coolant is eliminated and overheating of the engine is prevented.

Figure 10:
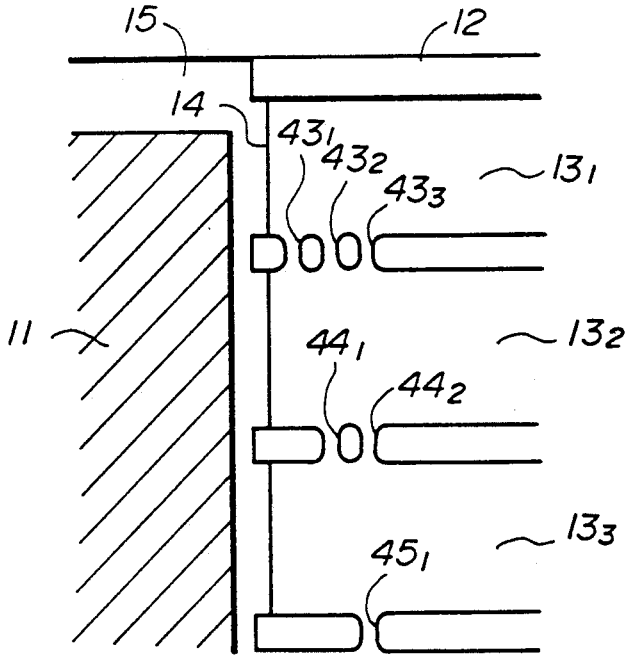
FIG. 10 is a partial cross sectional view of a fifth embodiment of the present invention.

FIG. 10 is a partial cross sectional view of a fifth embodiment of the present invention. In FIG. 10, those parts that are the same as corresponding parts in FIG. 4 are designated by the same reference numerals, and descriptions thereof will be omitted.

This embodiment features connecting ports $43_1 \sim 43_3$, $44_1$, $44_2$, and $45_1$, as introducing means for a coolant, provided on walls between annular grooves $13_1 \sim 13_3$. Similarly to the connecting ports $41_1 \sim 41_3$ in the third embodiment, the connecting ports $43_1 \sim 43_3$, $44_1$, $44_2$, and $45_1$ are located within angle range of $10° \sim 30°$ from the line A in FIG. 7, which line A is a line passing through the center of a vertical cross section of a longitudinal groove 14 and the center of a circular cross section of a cylinder liner 12, symmetrically on both sides of the line A.

Each of the connecting ports $43_1 \sim 43_3$, $44_1$, $44_2$, and $45_1$ comprises a notch formed on a wall between grooves, so as to connect two adjacent grooves, such as the grooves $13_1$ and $13_2$, the grooves $13_2$ and $13_3$, the groove $13_3$ and the lower groove not shown. Unlike the connecting ports $41_1 \sim 41_3$ in the third embodiment, the area of the cross section of the each connecting ports $43_1 \sim 43_3$, $44_1$, $44_2$, and $45_1$ is the same, but the positions of connecting ports $43_1 \sim 43_3$, $44_1$, $44_2$, and $45_1$ are varied.

Three connecting ports $43_1 \sim 43_3$ are located on a wall between the grooves $13_1$ and $13_2$. Two connecting ports $44_1$ and $44_2$ are located on a wall between the grooves $13_2$ and $13_3$. A single connecting groove $45_1$ is located on a wall between the grooves $13_3$ and the lower groove not shown. As mentioned above, a number of connecting ports provided becomes larger toward the upper portion of the cylinder liner 12. As shown in FIG. 10, toward the lower portion of the cylinder liner 12, the position of connecting ports closest to the longitudinal groove 14 progressively increases away from the longitudinal grove 14. The reason for this arrangement of the connecting ports $43_1 \sim 43_3$, $44_1$, $44_2$, and $45_1$ is so as to match the positions of the connecting ports to the positions where a stagnation is generated.

Apparently, by this embodiment, the coolant entering into the groove $13_1$ is led to the upstream portion of the groove $13_2$ via the connecting port $42_1$, and thus the coolant smoothly flows through the entire groove $13_2$ and a stagnation, shown in FIG. 2, is not generated. A coolant flow to the groove $13_3$ flows in the same manner as that in the groove $13_2$. Therefore, the boiling of the coolant is eliminated and overheating of the engine is prevented.

In addition, since the total area of the cross section of each of the connecting ports provided on the same wall becomes larger toward the upper portion of the cylinder liner 12, a distribution of the amount of the cooling flowing in the grooves $13_1 \sim 13_3$ can be matched to a distribution of the incoming heat of the cylinder liner 12. This results in a cooling effect which allows uniform temperature of the cylinder liner 12 to be maintained.

Figure 11:
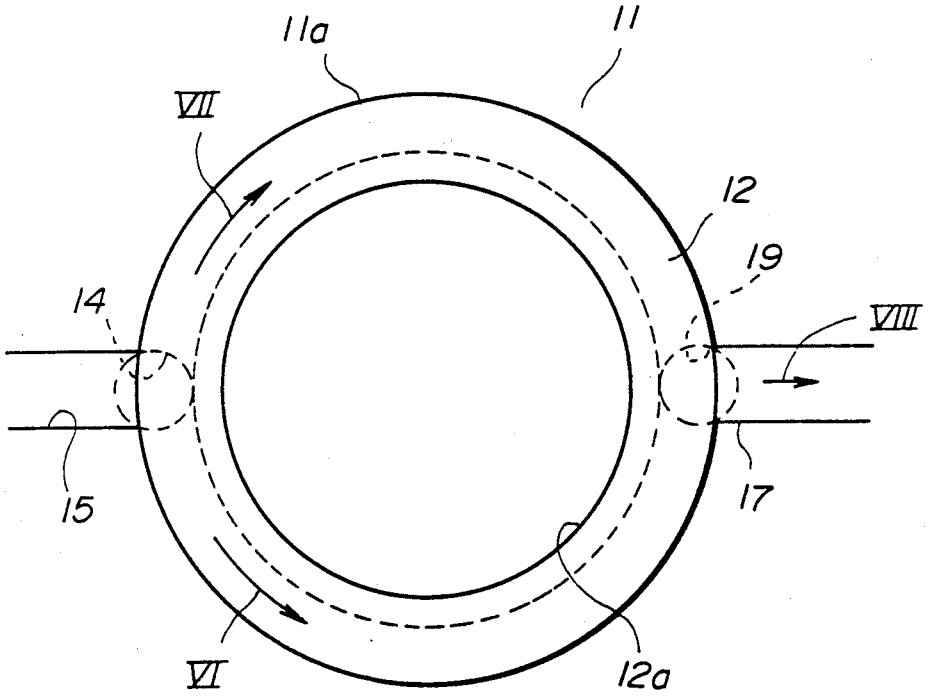
FIG. 11 is a plane view of a sixth embodiment of the present invention.
Figure 12:
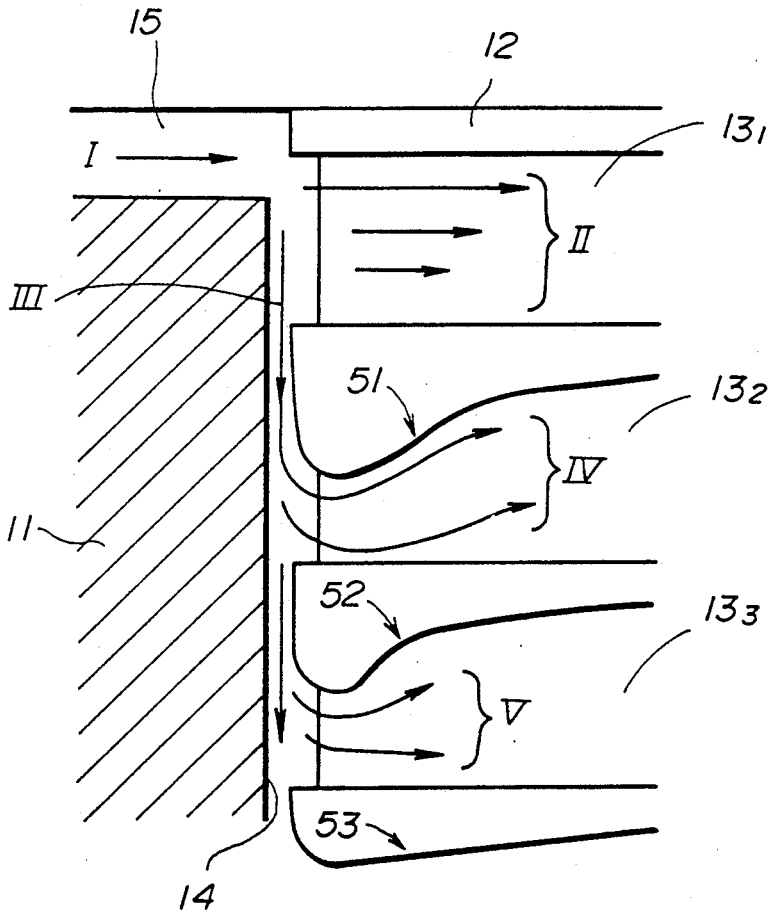
FIG. 12 is a partial cross sectional view of a sixth embodiment of the present invention.

A description will now be given of a sixth embodiment of the present invention with reference to FIG. 11 and FIG. 12. In FIGS. 11 and 12, those parts that are the same as corresponding parts in FIGS. 3 and 4 are designated by the same reference numerals, and descriptions thereof will be omitted.

In this embodiment the upper side of the wall between grooves protrudes at the coolant entrance portion. This protrusion serves as a coolant introducing means. A protrusion 51 is formed on the wall between the grooves $13_1$ and $13_2$. A protrusion 52 is formed on the wall between the grooves $13_2$ and $13_3$. A protrusion 53 is formed on the wall between the groove $13_3$ and the lower groove not shown. The protrusions 51 has the largest height and the height of other protrusions becomes progressively smaller toward the lower portion of the cylinder liner 12. Each of the protrusions 51~53 has a smooth curve that matches the stream line of the coolant flow around the entrance of the respective grooves.

Flow of the coolant in this embodiment is explained below. A coolant, delivered from a pump (not shown), flows into the inlet passage 15, as indicated by an arrow I. A portion of the coolant flows into the groove 14, then enters, without changing direction, into the uppermost groove $13_1$, as indicated by an arrow II. The rest of the coolant flows inside the longitudinal groove 14, as indicated by an arrow III, and a portion thereof flows into the groove $13_2$. The remaining coolant flows to the lower part of the longitudinal groove 14. In the same manner, a portion of the coolant flows into the groove $13_3$, as indicated by an arrow V.

After the coolant enters into the annular grooves $13_1 \sim 13_3$, the coolant flows along the grooves $13_1 \sim 13_3$, as indicated by arrows VI and VII in FIG. 11, while absorbing heat from the cylinder liner 12, then the coolant in each groove $13_1 \sim 13_3$ enters the longitudinal groove 19. The coolant from the grooves $13_1 \sim 13_3$ flows together in the groove 19 and the joined coolant flows out via the outlet passage 17.

In this embodiment, the protrusion 51 is formed on the upper side of the wall, where a stagnation is generated in the conventional cooling system. The coolant flows along the protrusion 51 and the direction of flow is smoothly changed to the direction of the groove $13_1$. Accordingly, a stagnation of the coolant is not generated in the groove $13_1$. The coolant entering the lower grooves flows in the same manner as that in the groove $13_1$. Therefore, the boiling of the coolant is eliminated and overheating of the engine is prevented.

Additionally, the protrusions 51~53 being formed near the longitudinal groove 14 results in that a wall of the cylinder liner 12 is thicker at this particular portion; rigidity of the cylinder liner 12 is increased and thus the reliability of the cooling system is improved.

Figure 13:
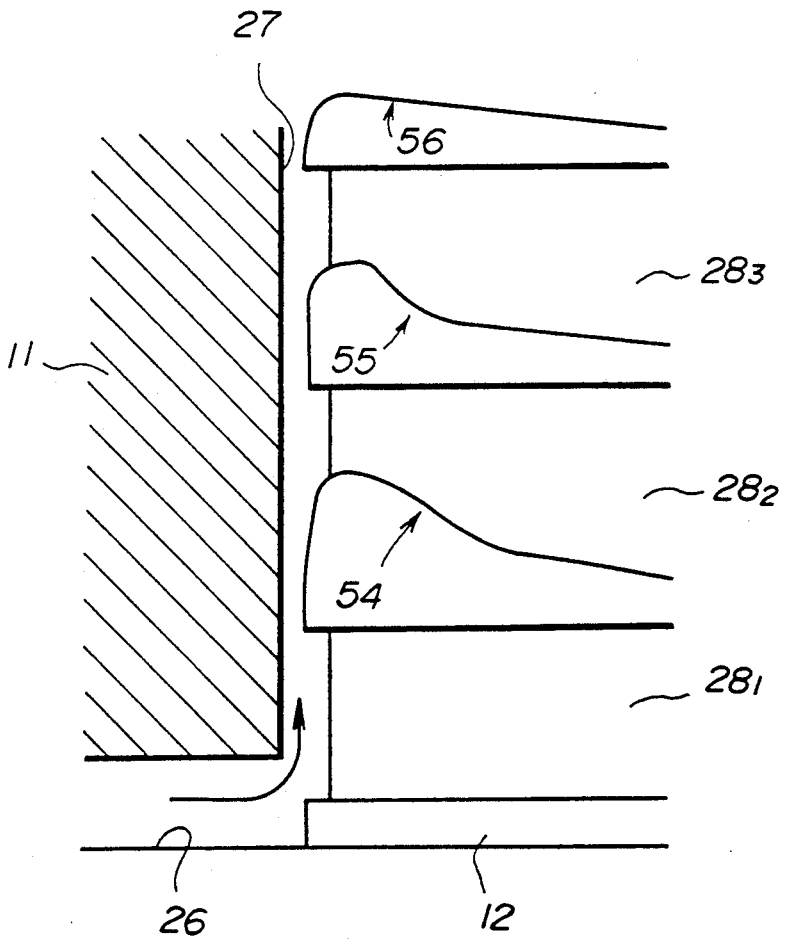
FIG. 13 is a partial cross sectional view of a variation of the sixth embodiment of the present invention.

FIG. 13 is a partial cross sectional view of a variation of a sixth embodiment of the present invention. In FIG. 13, those parts that are the same as corresponding parts in FIG. 4 are designated by the same reference numerals, and descriptions thereof will be omitted.

A cylinder liner 12', having a plurality of annular grooves $28_1 \sim 28_3$, is fitted in a cylinder block 11. An inlet passage 26 is formed on the bottom side of the cylinder block 11 and is connected to the longitudinal groove 27. The grooves $28_1 \sim 28_3$, inlet passage 26 and groove 27 respectively correspond to grooves $13_1 \sim 13_3$, inlet passage 15 and groove 14 in FIG. 12. However, in this system, a coolant is introduced to the longitudinal groove 27 from the bottom side of the cylinder liner 12'. Accordingly, the highest protrusion 54 is formed on the wall between the grooves $28_1$ and $28_2$, the second highest between the grooves $28_2$ and $28_3$, the third highest between the groove $28_3$ and the lower groove, not shown, and so on.

Obviously, this system has the same coolant flow as that in the sixth embodiment mentioned above with respect to prevention of a stagnation of a coolant.

Figure 14:
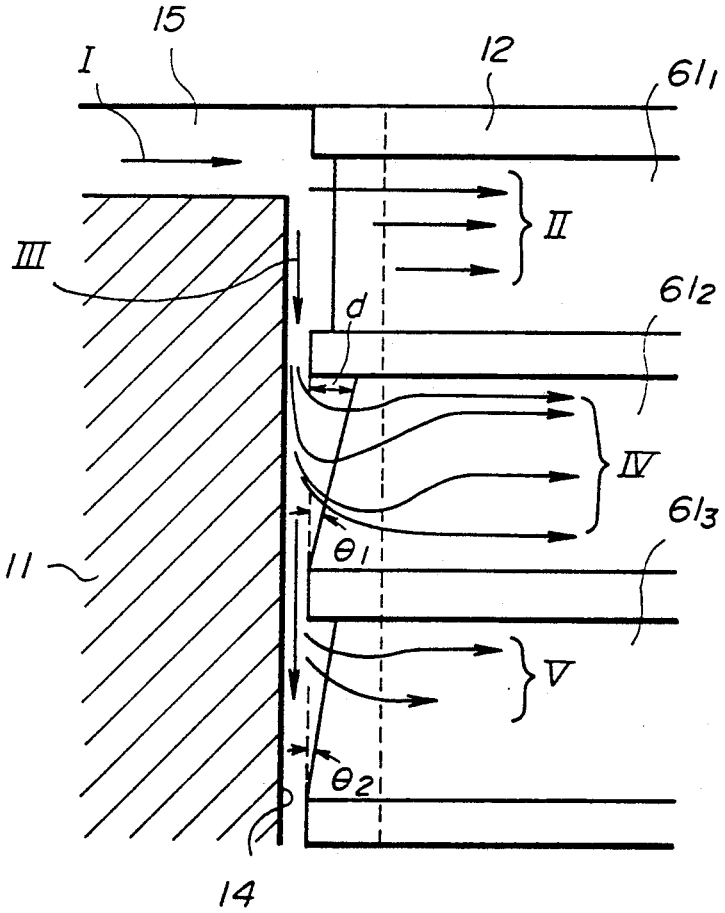
FIG. 14 is a partial cross sectional view of a seventh embodiment of the present invention.

A description will now be given of a seventh embodiment of the present invention with reference FIG. 11 and FIG. 14. In FIG. 14, those parts that are the same as corresponding parts in FIG. 4 are designated by the same reference numerals, and descriptions thereof will be omitted. FIG. 11 is used, for the sake of convenience, because a plane view of the seventh embodiment appear the same as that of the sixth embodiment.

A plurality of annular grooves $61_1 \sim 61_3$ correspond to the annular grooves $13_1 \sim 13_3$ of FIG. 4. Each of the grooves $61_2$ and $62_3$ has a slanting surface of the cylinder liner 12, which surface serves as introducing means for coolant. A slanting angle $\theta_1$ of the groove $61_2$ is larger than a slanting angle $\theta_2$ of the groove $61_3$. In other words, a depth of the groove $61_2$ along the wall of the upstream side, indicated by an arrow d, is deeper than that of the groove $61_3$. The slanting angle $\theta$ becomes progressively smaller toward the lower portion of the cylinder liner 12.

Flow of the coolant in this embodiment is explained below. A coolant, delivered from a pump (not shown), flows into the inlet passage 15, as indicated by an arrow I. A portion of the coolant flows into the groove 14, then enters, without changing direction, into the uppermost groove $61_1$, as indicated by an arrow II. The rest of the coolant flows inside the longitudinal groove 14, as indicated by an arrow III, a portion thereof flows into the groove $61_2$, and the remaining coolant flows to the lower part of the longitudinal groove 14. In the same manner, a portion of the coolant flows into the groove $61_3$, as indicated by an arrow V.

After the coolant enters the annular grooves $61_1 \sim 61_3$, the coolant flows along the grooves $61_1 \sim 61_3$, as indicated by arrows VI and VII in FIG. 11, while absorbing heat from the cylinder liner 12, then the coolant in each groove $61_1 \sim 61_3$ enters the longitudinal groove 19. The coolant from the grooves $61_1 \sim 61_3$ flows together in the groove 19 and the joined coolant flows out via the outlet passage 17.

In this embodiment, the coolant, flowing into the groove $61_1$ and having a high velocity, flows preferentially along the upper portion of the groove $61_1$, where a stagnation is generated in the conventional cooling system, rather than flowing along the lower portion of the groove because a cross section of the passage for the coolant is larger in the upper portion due to the slanting surface of the cylinder liner 12 along the groove $61_1$. Accordingly, a stagnation of the coolant is not generated in the groove $61_1$. The coolant entering the lower grooves flows in the same manner as that in the groove $61_1$. Therefore, the boiling of the coolant is eliminated and overheating of the engine is prevented.

In addition, a rigidity of the cylinder liner 12 is increased as compared to that of the conventional cooling system, because the slanting surfaces of the cylinder along the annular grooves results in a thicker wall of the cylinder liner 12. Thus a reliability of the cooling system is improved.

Further, since the area of the cross section of each of the grooves $61_1 \sim 61_3$ becomes progressively smaller towards the lower portion of the cylinder liner 12, a distribution of the amount of the coolant flowing in the grooves $61_1 \sim 61_3$ can be matched to a distribution of the incoming heat of the cylinder liner 12. This results in a cooling effect which allows uniform temperature of the cylinder liner 12 to be maintained.

Figure 15:
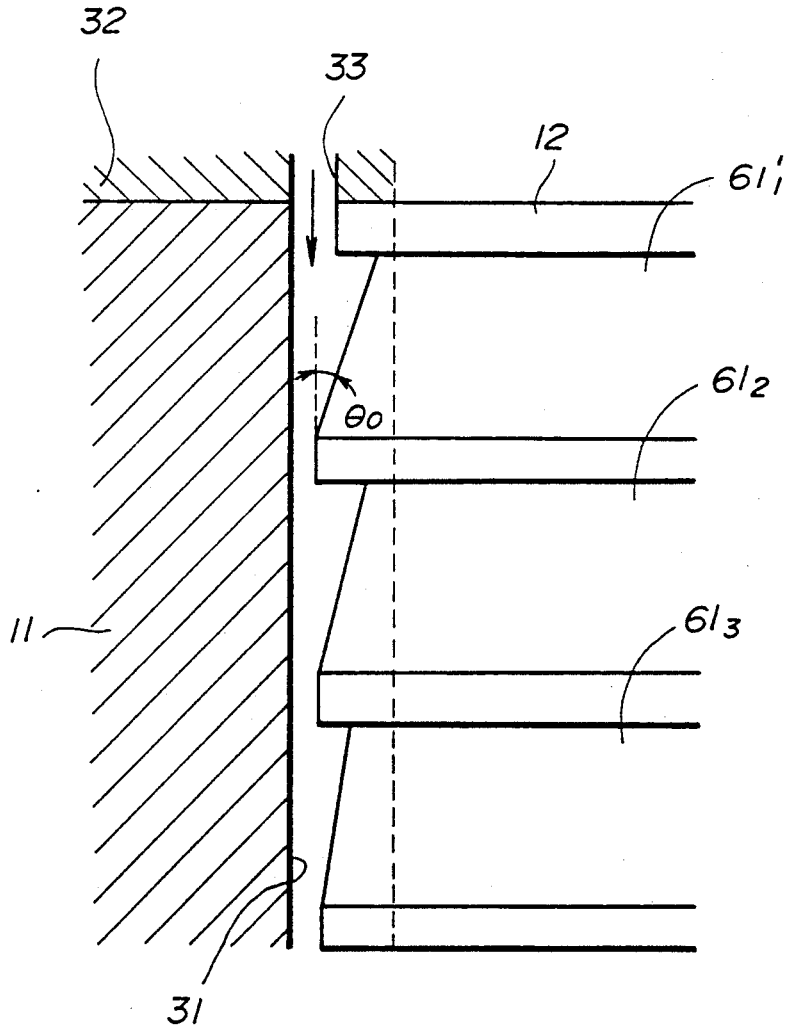
FIG. 15 is a partial cross sectional view of a variation of the seventh embodiment of the present invention.

FIG. 15 is a partial cross sectional view of a variation of the seventh embodiment of the present invention. In FIG. 15, those parts that are the same as corresponding parts in FIG. 14 are designated by the same reference numerals, and descriptions thereof will be omitted.

Unlike the seventh embodiment mentioned above, this cooling system includes an inlet passage 33, formed in a cylinder head 32, extending in a direction along a longitudinal groove 31. In this construction, the uppermost annular groove $61_1'$ also has a slanting surface with a slanting angle $\theta_0$ which angle is larger than $\theta_1$ of the lower groove $61_2$. This is because a direction of a coolant entering into the groove $61_1'$ is also changed approximately 90° and the largest stagnation is generated at an entrance of the groove $61_1'$.

This cooling system has the same effect as that of the seventh embodiment mentioned above.

It should be noted that the introducing means, described in the above embodiments, can be applied to a cooling system in which an inlet passage is formed at a portion most distant from a cylinder head, that is a lower portion of the cylinder liner. In this case the same effect as is in the embodiments above will be realized.

The present invention is not limited to the specifically disclosed embodiments, and variations and modifications may be made without departing from the scope of the present invention.

What is claimed is:

1. A cooling system for an internal combustion engine comprising:

a supply source of a coolant for cooling a cylinder liner;

a plurality of annular passages formed between a cylinder block and said cylinder liner fitted in the cylinder block, the passages extending along a circumference of an outer surface of said cylinder liner, said passages being spaced apart from each other in an axial direction of said cylinder liner;

an inflow and an outflow passage for a coolant, connecting said plurality of annular passages, extending in a direction of an axis of said cylinder liner, and provided at diametrically opposite sides of said cylinder liner;

an inlet passage for supplying a coolant to said inflow passage;

introducing means for directing a flow of coolant into said annular passages and for preventing stagnation of the coolant when the coolant is introduced to said annular passages; and wherein said introducing means comprises guiding members for guiding the flow of a portion of the coolant entering into each of said annular grooves by diverting a portion of the coolant flowing therein to a direction perpendicular to a longitudinal direction of said inflow passage.

2. A cooling system as claimed in claim 1, wherein said inlet passage is provided in an extension direction of said inflow passage and said guiding members are provided for all of the annular passages.

3. A cooling system as claimed in claim 1, wherein said inlet passage is provided in an extension direction of said inflow passage and said introducing means comprises slanting surfaces in all of said annular passages including the passage located at the highest point of a coolant flow within the cylinder liner.

4. A cooling system for an internal combustion engine comprising:

a supply source of a coolant for cooling a cylinder liner;

a plurality of annular passages formed between a cylinder block and said cylinder liner fitted in the cylinder block, the passages extending along a circumference of an outer surface of said cylinder liner, said passages being spaced apart from each other in an axial direction of said cylinder liner;

an inflow and an outflow passage for a coolant, connecting said plurality of annular passages, extending in a direction of an axis of said cylinder liner, and provided at diametrically opposite sides of said cylinder liner;

an inlet passage for supplying a coolant to said inflow passage;

introducing means for directing a flow of coolant into said annular passages and for preventing stagnation of the coolant when the coolant is introduced to said annular passages; and wherein said introducing means comprises guiding members provided on a surface of said inflow passage and positioned in an upper half portion of all but one of said annular passages.

5. A cooling system as claimed in claim 4, wherein each of said guiding members have a square cross section and a triangular shape with a vertex directed toward said annular passages.

6. A cooling system as claimed in claim 4, wherein each of said guiding members has a slanting surface slanting so as to smoothly change the direction of coolant flow flowing into the annular passages.

7. A cooling system for an internal combustion engine comprising:

a supply source of a coolant for cooling a cylinder liner;

a plurality of annular passages, formed between a cylinder block and said cylinder liner fitted in the cylinder block, the passages extending along a circumference of an outer surface of said cylinder liner, said passages being spaced apart from each other in an axial direction of said cylinder liner;

an inflow and an outflow passage for a coolant, connecting said plurality of annular passages, extending in a direction of an axis of said cylinder liner, and provided at diametrically opposite sides of said cylinder liner;

an inlet passage for supplying a coolant to said inflow passage;

introducing means for directing a flow of coolant into said annular passages and for preventing stagnation of the coolant when the coolant is introduced to said annular passages; and wherein said introducing means comprises connecting ports connecting adjacent ones of said annular passages, the ports being provided within a predetermined angle range from a line, which is a line passing through a center of a vertical section of said inflow passage and passing through a center of the cylinder liner.

8. A cooling system as claimed in claim 7, wherein said predetermined angle range is 10° to 30°.

9. A cooling system as claimed in claim 7, wherein a cross section area of said connecting port located in the uppermost position is largest and the area of ports provided to consecutive passages becomes progressively smaller toward the lower portion of the cylinder liner.

10. A cooling system as claimed in claim 7, wherein a cross section area of each of said connecting ports is uniform, and a distance between the inflow passage and each of said connecting ports becomes progressively larger toward the lower portion of the cylinder liner.

11. A cooling system as claimed in claim 7, wherein at least one of said connecting ports, having a uniform cross section area, is provided between adjacent annular passages, and a number of said connecting ports becomes progressively larger toward the upper portion of the cylinder liner.

12. A cooling system for an internal combustion engine comprising:

a supply source of a coolant for cooling a cylinder liner;

a plurality of annular passages formed between a cylinder block and said cylinder liner fitted in the cylinder block, the passages extending along a circumference of an outer surface of said cylinder liner, said passages being spaced apart from each other in an axial direction of said cylinder liner;

an inflow and an outflow passage for a coolant, connecting said plurality of annular passages, extending in a direction of an axis of said cylinder liner, and provided at diametrically opposite sides of said cylinder liner;

an inlet passage for supplying a coolant to said inflow passage;

introducing means for directing a flow of coolant into said annular passages and for preventing stagnation of the coolant when the coolant is introduced to said annular passages; and wherein said introducing means comprises a plurality of protrusions, wherein one of said protrusions is formed on an upper wall of all but one of said annular passages, the height of said protrusions decreasing gradually toward the downstream portion of said annular passages so that a curve of each of said protrusions matches a stream line of a coolant.

13. A cooling system as claimed in claim 12, wherein a maximum height of each of said protrusions decreases toward the lower portion of the cylinder liner.

14. A cooling system for an internal combustion engine comprising:

a supply source of a coolant for cooling a cylinder liner;

a plurality of annular passages formed between a cylinder block and said cylinder liner fitted in the cylinder block, the passages extending along a circumference of an outer surface of said cylinder liner, said passages being spaced apart from each other in an axial direction of said cylinder liner;

an inflow and an outflow passage for a coolant, connecting said plurality of annular passages, extending in a direction of an axis of said cylinder liner, and provided at diametrically opposite sides of said cylinder liner;

an inlet passage for supplying a coolant to said inflow passage;

introducing means for directing a flow of coolant into said annular passages and for preventing stagnation of the coolant when the coolant is introduced to said annular passages; and wherein said introducing means comprises a plurality of slanting surfaces, wherein one of said slanting surfaces is provided for all but one of said annular passages of said cylinder liner, said slanting surfaces slanting so that a width of the upper portion of said one annular passage is larger than the widths of the upper portions of the other annular portions.

15. A cooling system as claimed in claim 14, wherein the slanting angles of said slanting surfaces provided for all but one of said annular passage becomes smaller toward the lower portion of the cylinder liner.

* * * * *